United States Patent [19]

Takahori et al.

[11] Patent Number: 5,017,184

[45] Date of Patent: May 21, 1991

[54] CUT LENGTH ADJUSTING APPARATUS

[75] Inventors: Mutsuo Takahori; Hidehumi Hirahara, both of Mihara, Japan

[73] Assignee: Mitsubishi Jukogyo Kabushiki Kaisha, Tokyo, Japan

[21] Appl. No.: 418,330

[22] Filed: Oct. 6, 1989

[30] Foreign Application Priority Data

Oct. 19, 1988 [JP] Japan ..... 63-135434

[51] Int. Cl.[5] ..... B65H 35/08; B26D 1/62; B26D 7/26

[52] U.S. Cl. ..... 493/368; 493/471; 493/475; 83/343; 83/674; 83/699

[58] Field of Search ..... 83/343, 674, 699; 493/356, 357, 359, 363, 367, 368, 370, 471, 475

[56] References Cited

U.S. PATENT DOCUMENTS

| | | | |
|---|---|---|---|
| 2,372,780 | 4/1945 | Hess | 83/674 |
| 2,941,798 | 6/1960 | Harless | 493/353 |
| 3,369,436 | 2/1968 | Loase | 83/343 |
| 3,405,580 | 10/1988 | Hauden | 83/343 |
| 3,460,823 | 8/1969 | Neal et al. | 493/431 |
| 3,768,801 | 10/1973 | Maynard et al. | 83/346 |
| 4,004,478 | 1/1977 | Morgan | 83/343 |
| 4,009,626 | 3/1977 | Gressman | 83/699 |
| 4,295,843 | 10/1981 | Otomaru | 493/368 |
| 4,742,741 | 5/1988 | Hallberg et al. | 83/674 |
| 4,911,047 | 3/1990 | Hornung et al. | 83/699 |

FOREIGN PATENT DOCUMENTS

| | | |
|---|---|---|
| 1786292 | 1/1972 | Fed. Rep. of Germany . |
| 2348023 | 11/1977 | France . |

*Primary Examiner*—William E. Terrell

*Attorney, Agent, or Firm*—Wenderoth, Lind & Ponack

[57] ABSTRACT

An improved cut length adjusting apparatus in a folding machine of a rotary press is disclosed. The folding machine generally includes only a cutting drum having two knife blades disposed along its circumference nearly at equal angular intervals, and a folding drum rotating synchronously with but in the opposite direction to the cutting drum. The knife drum is formed of an outer cylinder and an inner cylinder which are mutually rotatable and which each have one knife blade respectively projecting therefrom. The improvements reside in that a helical gear adapted to mesh with another helical gear at the axial end of the folding drum is provided at the axial end of at least one of the outer and inner cylinders, and either one of the helical gear at the axial end of the outer or inner cylinders and the helical gear at the axial end of the folding drum is movable in the axial direction. Owing to the improved structure, by moving either one of the above-mentioned helical gears in the axial direction, the outer cylinder and the inner cylinder are relatively rotated, and so, the circumferential distance between the two saw blades is varied. Thus the cut length of a sheet to be cut by these saw blades can be precisely set.

4 Claims, 3 Drawing Sheets

X
X
1
2
3
35
13
13a
13a
31
12
1'
2'
3'
11
31
12
28
28
23a
24
14
45
12a
16
17a
29
17
19
21
20
30
18
17a
22
23b
27
26
25

13
1
2
3
2'
1'
3'
12
11

CUT LENGTH ADJUSTING APPARATUS

BACKGROUND OF THE INVENTION

1. Field of the Invention

The present invention relates to a cut length adjusting apparatus capable of cutting a continuous paper web into equal lengths and laterally into various cut lengths, and especially to such an apparatus applicable to a folding machine in a rotary press (in particular, a rotary press for newspapers).

2. Description of the Prior Art

The requirement for effecting unequal length cutting with a cutting drum include the capability of effecting an adjustment of cut-off lengths of superposed sheets (as will be described later) depending upon a total number of pages after having switched from straight folding to collective folding (See FIG. 3(*a*)), the capability of effecting an adjustment when it is desired to increase a circumferential length of a pattern, and the like.

To that end, as shown in FIG. 3, in the prior art either one or both of a pair of cutting cases 02 each holding a knife blade 01 are moved within a groove 04 of a cutting drum 03. And, after a cut length between the knife blades 01 and 01' is adjusted by means of a spacer 05, the cutter cases 02 are fixed by means of wedges 06.

However, the apparatus in the prior art as described above gives rise to the following problems:

(1) While it is necessary to change a cut-off length between a folded sheet held in contact with a cutting drum (hereinafter called "sheet A") and a folded sheet superposed on the first folded sheet (hereinafter called "sheet B") depending upon the superposed number of the sheets A and B when straight folding has been switched to collective folding, according to the method in the prior art it a great amount of time for extracting the wedges, and a total adjustment time of about 10 minutes, is necessitated.

(2) Since the cut-off lengths of the sheets A and B are adjusted by means of the spacers, human labor is necessarily required to exchange such. Hence, a remote control or unmanned operation cannot be realized.

(3) The adjustment of the cut-length size of the sheets in a stepless manner cannot be achieved.

SUMMARY OF THE INVENTION

It is therefore one object of the present invention to provide a cut length adjusting apparatus which can adjust a cut length of paper sheets quickly and in a stepless manner.

According to one feature of the present invention, in a folding machine of a rotary press consisting of a cutting drum having two knife blades disposed at nearly equal intervals along the circumference thereof and a folding drum rotating synchronously with but in the opposite direction to the cutting drum, the cutting drum comprises an outer cylinder and an inner cylinder each having one knife blade respectively projecting therefrom and mutually rotatable, a helical gear adapted to mesh with another helical gear at the axial end of the folding drum is provided at the axial end of at least one of the outer cylinder and the inner cylinder, and either one of the helical gear at the axial end of the outer or inner cylinder and the helical gear at the axial end of the folding drum is movable in the axial direction, whereby the outer and inner cylinders can be relatively rotated by moving either one of the helical gears in the axial direction.

More particularly, the characteristic features of the present invention reside in the following points:

(1) A cutting drum is formed of an outer cylinder supporting one knife blade and an inner cylinder disposed within the outer cylinder and supporting the other knife blade. A helical gear mounted on the outer cylinder so as to be slidable in the axial direction is moved by means of a moving device, and the outer cylinder is made to rotate in the circumferential direction by the action of a driving helical gear meshed with the first-mentioned helical gear and fixed to the folding drum.

(2) During the period when the outer cylinder rotates in the circumferential direction, rotation of the inner cylinder is restrained by the provision of a gear, such as a helical gear or the like, mounted to the shaft of the inner cylinder and which gear is always in meshing engagement with another driving gear such as a driving helical gear or the like fixed to the folding drum.

(3) A reversal of the operative relationship described in paragraphs (1) and (2) above is acceptable. That is, rotation of the inner cylinder and a restraint of the rotation of the outer cylinder are acceptable.

(4) The helical gear that is slidable in the axial direction as described in paragraph (1) above, could be the helical gear mounted to the folding drum.

During operation of the cut length adjusting apparatus according to the present invention as featured above, since either one of the helical gear on one of the inner and outer cylinders and the helical gear at the end of the folding drum can move in a stepless manner, the knife blade disposed on the outer cylinder can be moved in the circumferential direction of the saw drum in a stepless manner with respect to a knife blade disposed on the inner cylinder and held at a fixed position. Therefore, the cut-off length can be adjusted in a stepless manner.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENT

Figure 1A:
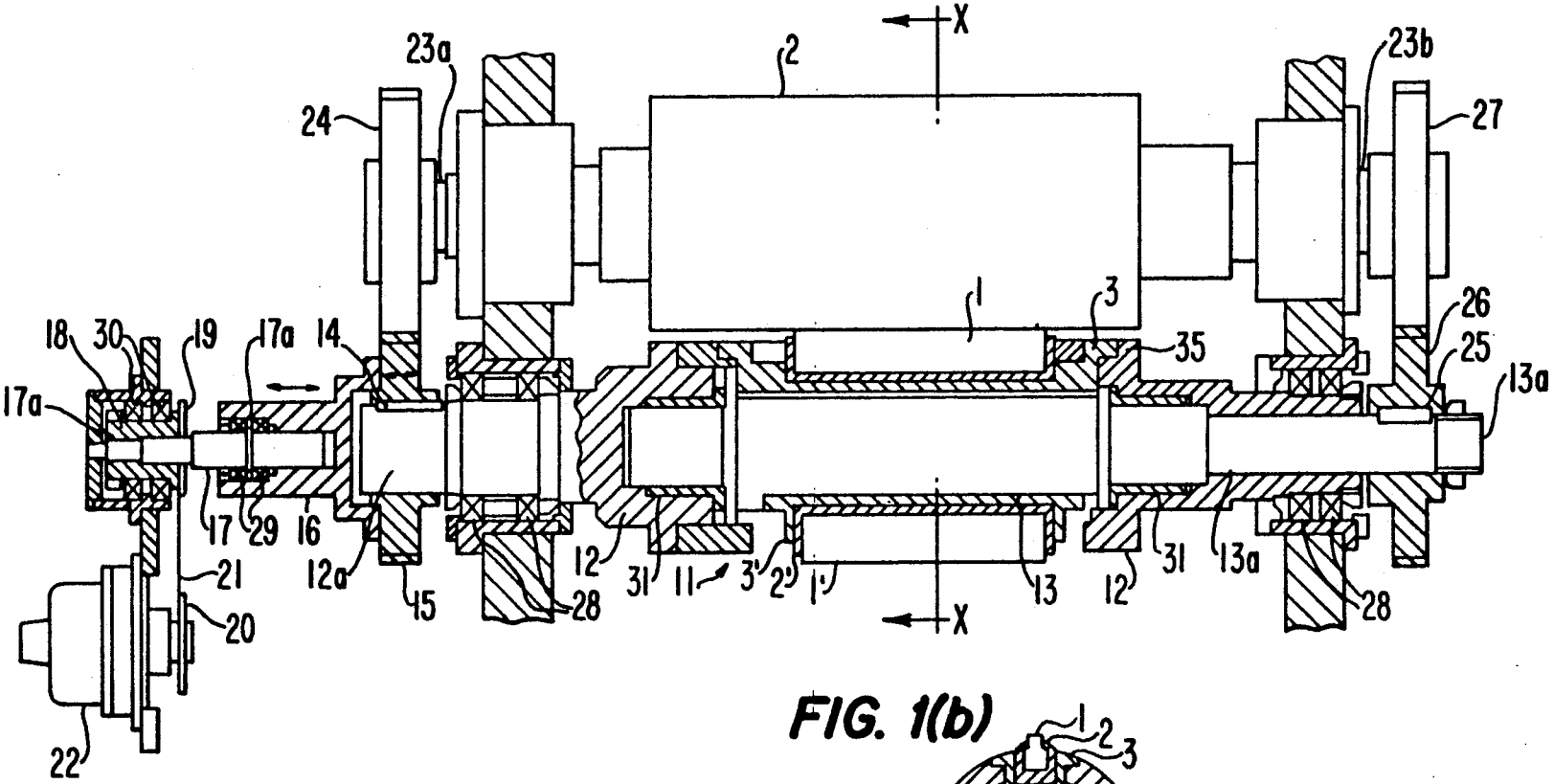
FIG. 1 shows one preferred embodiment of the present invention, FIG. 1(*a*) being a longitudinal cross-sectional view of a cutting drum and a folding drum, and FIG. 1(*b*) being a transverse cross-sectional view taken along line X—X in FIG. 1(*a*)
Figure 1B:
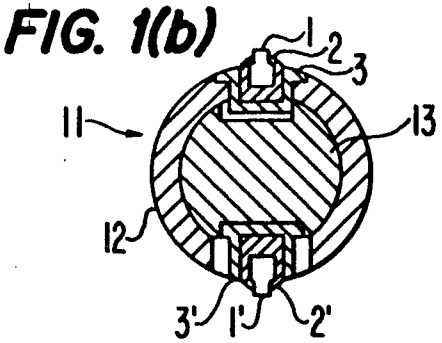

One preferred embodiment of the cut length adjusting apparatus according to the present invention is illustrated in FIG. 1. In this figure, reference numerals 1 and 1' designate saw blades, numerals 2 and 2' designate numeral 11 designates a knife drum, numeral 12 designates an outer cylinder, numeral 13 designates an inner cylinder, numeral 14 designates a slide key, numeral 15 designates a helical gear, numeral 16 designates a shifter, numeral 17 designates a screw rod, numeral 18 designates a rotary body, numerals 19 and 20 designate sprockets, numeral 21 designates a chain, numeral 22 designates a motor, numeral 23 designates a folding drum, numeral 24 designates a helical gear, numeral 25 designates a key, numerals 26 and 27 designate helical gears, numerals 28, 29 and 30 designate bearings, and numeral 31 designates a bush.

The cutting drum 11 comprises the outer cylinder 12 and the inner cylinder 13 inserted within the outer cylinder 12, and the inner cylinder 13 is rotatably supported via the bush 31 within the outer cylinder 12.

Figure 3A:
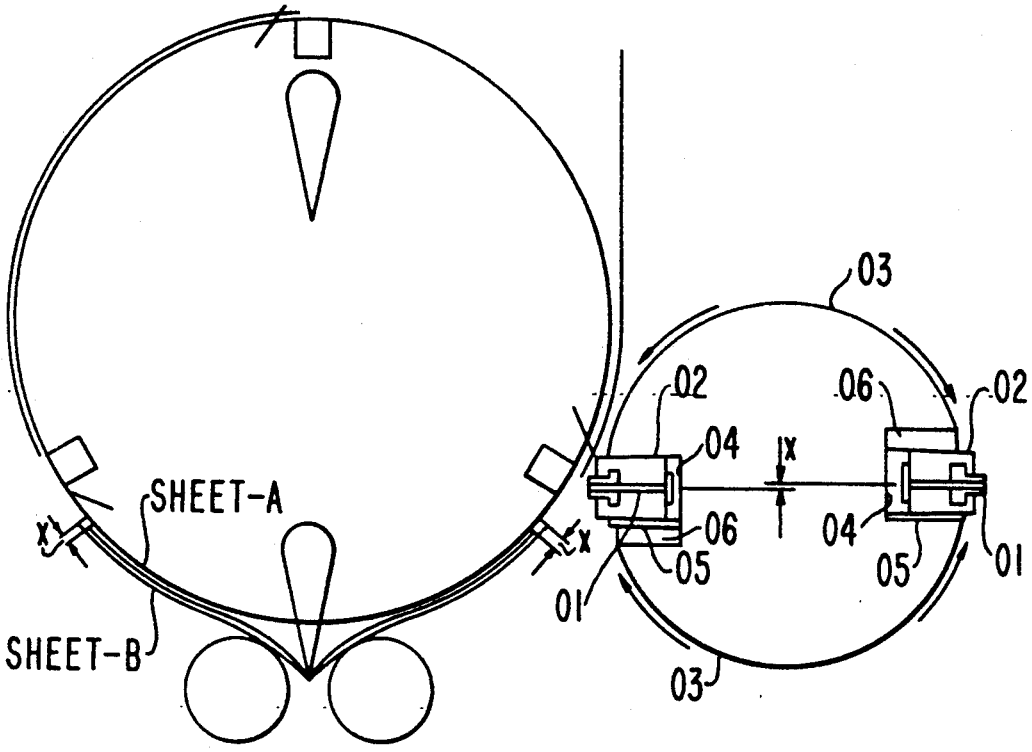
FIG. 3(a) (PRIOR ART)
FIG. 3 shows a cut length adjusting apparatus in the prior art which relies upon manual operations, FIG. 3(*a*) being a schematic transverse cross-sectional view of a cutting drum and a folding drum, and FIG. 3(*b*) being a schematic enlarged partial view of the cutting drum in the prior art.
Figure 3B:
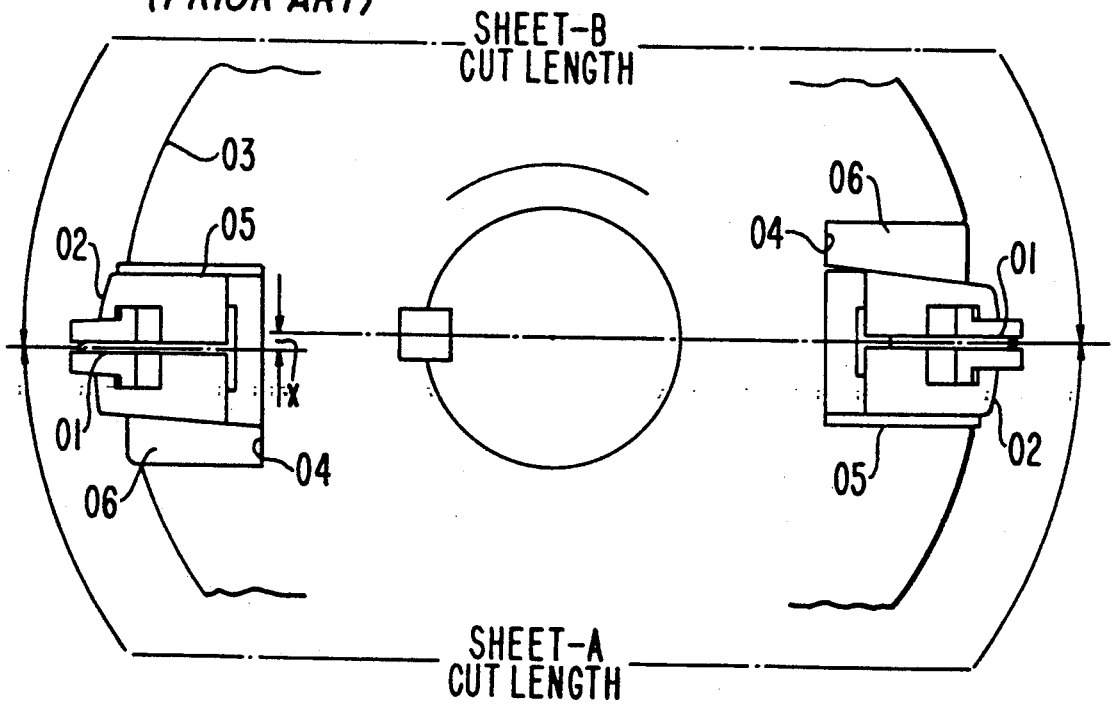
FIG. 3(b) (PRIOR ART)

To the outer cylinder 12 is fixedly secured the cutter case 2 holding the knife blade 1 via the mount piece 3, while to the inner cylinder 13 is fixedly secured the cutter case 2' holding the knife blade 1' via the mount piece 3'. The knife blades 1 and 1' are disposed at diametrically nearly opposed positions on the circumference of the outer cylinder 12 as shown in FIG. 1(*b*), and their tip ends project from the outer circumference of the outer cylinder 12. Also, as shown in FIG. 1(*b*) gaps are provided between the mount piece 3 and the inner cylinder 13 and between the mount piece 3' and the outer cylinder 12 respectively, so that the outer cylinder 12, the mount piece 3, the cutter case 2 and the knife blade 1 can rotate in the circumferential direction relative to the inner cylinder 13, the mount piece 3', the cutter case 2' and the knife blade 1'. At one axial end 12*a* of the outer cylinder 12 is provided the helical gear 15 which is mounted via the key 14 or splines so as to be slidable in the axial direction. The shifter 16 mounted to the gear 15 is threadedly engaged with a threaded flange portion 17*a* of the screw rod 17. When the sprocket 19 fixedly secured to the rotary body 18 is rotated via the chain 21 by the sprocket 20 mounted to the axial end of the motor 22 associated with reduction gears, the gear 15 is moved in the axial directions (in the directions of arrows) by the threaded flange portion 17*a* of the screw rod 17. Since the helical gear 24 for driving the outer cylinder 12 mounted at one axial end 23*a* of the folding drum 23 is meshed with the helical gear 15, as a result of the axial movement of the gear 15, the helical gear 15 would rotate in the circumferential direction depending upon the twist angle of the helical gear. On the other hand, at the axial end 13*a* of the inner cylinder 13 opposite to the above-described axial end 12*a* of the outer cylinder 12, is provided the helical gear 26 which is mounted via the key 25. Since the helical gear 26 is meshed with the helical gear 27 mounted on the other axial end 23*b* of the folding drum 23 for driving the inner cylinder 13, rotation of the inner cylinder 13 in the circumferential direction can be prevented by the helical gear 27 which is held at a stationary state during stoppage of the folding machine. Since the outer cylinder 12 rotates with respect to the inner cylinder 13 that is held at a stationary state in the above-described manner, a difference would arise between the interval in the circumferential direction from the knife blade 1 to the knife blade 1' and the interval in the circumferential direction from the knife blade 1' to the knife blade 1, and so, the cut lengths of the sheet-A and the sheet-B would be different (See FIG. 3). Accordingly, the cut lengths of the sheet-A and the sheet-B can be adjusted in a stepless manner. It is to be noted that the parameters P.C.D. (pitch circle diameter) of the helical gears 15, 24, 26 and 27 are all the same, and the outer cylinder 12, the shifer 16 and the rotary body 18 are rotatably supported by the bearings 28, 29 and 30, respectively.

Also it is to be noted that in the above-described structure, in place of the helical gear 26 mounted to the inner cylinder 13 and the helical gear 27 mounted to the folding drum 23 and meshing with the helical gear 26, spur gears could be employed.

Figure 2A:
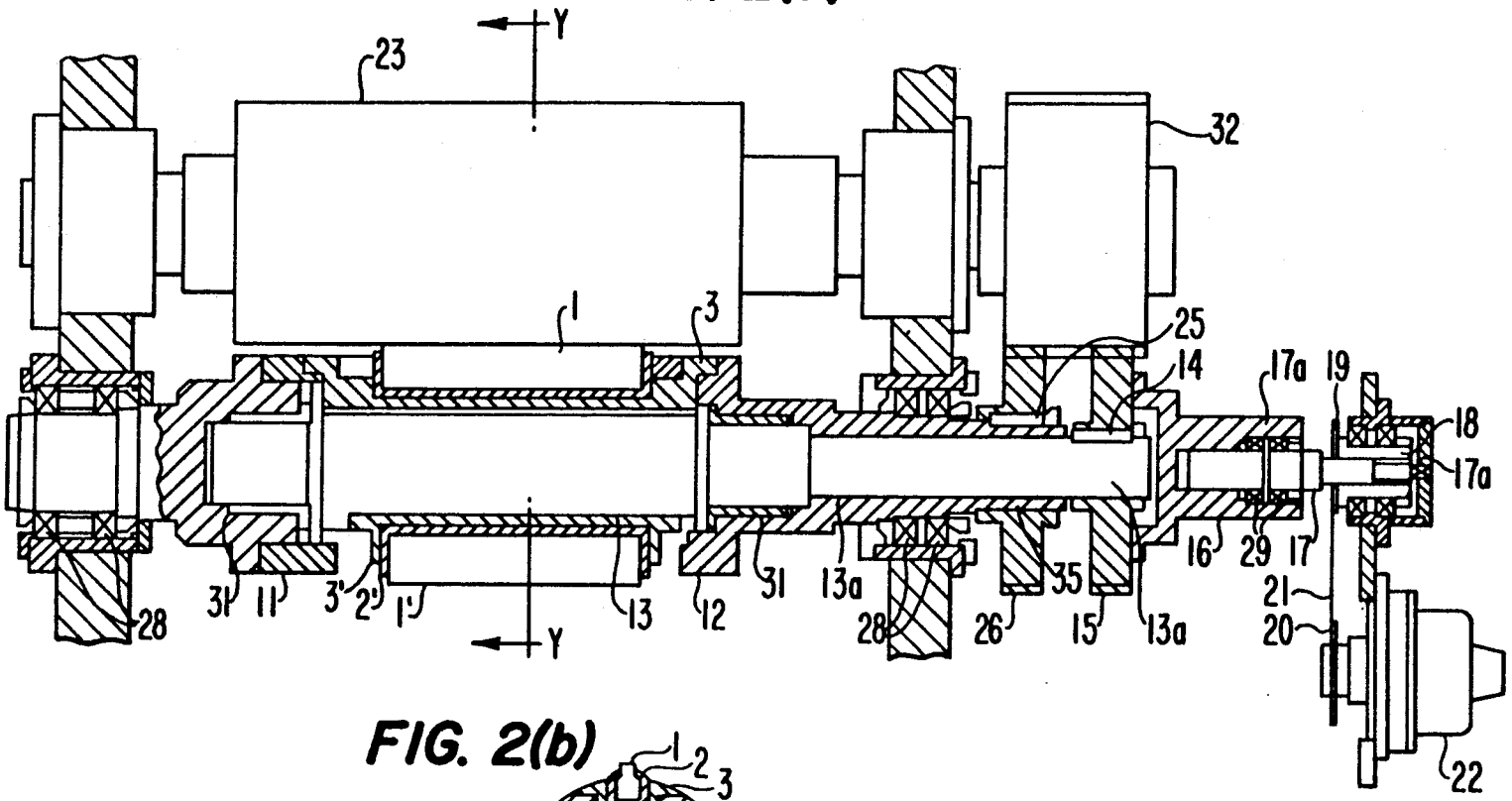
FIG. 2 shows another preferred embodiment of the present invention, FIG. 2(*a*) being a longitudinal cross-sectional view of a cutting drum and a folding drum, and FIG. 2(*b*) being a transverse cross-sectional view taken along line Y—Y in FIG. 2(*a*)
Figure 2B:
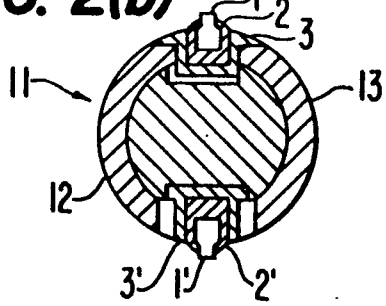

Another preferred embodiment of the present invention which is somewhat different from the first preferred embodiment in FIG. 1, is illustrated in FIG. 2.

In the embodiment shown in FIG. 2, the gear 15 for the inner cylinder of the cutting drum and the gear 26 for the outer cylinder are not disposed at the respective ends of the saw drum, but are both located on one end thereof. Accordingly, in contrast to the fact that in FIG. 1 two gears mounted to the folding drum are necessary, that is, the helical gear 24 and helical gear 27, in the embodiment shown in FIG. 2 only a single helical gear 32 is necessary. While the axially movable helical gear 15 and the slide key 14 are mounted to the axial end 12*a* of the outer cylinder on the left side in the embodiment shown in FIG. 1, in FIG. 2 they are mounted to the axial end 13*a* of the inner cylinder 13 on the right side. In addition, although the moving device such as the motor associated with reduction gears is disposed on the right side in the embodiment shown in FIG. 2, the effects and advantages of the apparatus are identical.

As will be seen from the detailed description above, according to the present invention, in a folding machine of a rotary press consisting of a cutting drum having two knife blades disposed at nearly equal intervals along the circumference thereof and folding drum rotating synchronously with but in the opposite direction to the cutting drum, owing to the fact that the cutting drum comprises an outer cylinder and an inner cylinder each having one knife blade respectively projecting therefrom and mutually rotatable, a helical gear adapted to mesh with another helical gear at the axial end of the folding drum is provided at the axial end of at least one of the outer cylinder and the inner cylinder, either one of the helical gear at the axial end of the outer or inner cylinder and the helical gear at the axial end of the folding drum is formed to be movable in the axial direction, and the outer and inner cylinders are rotatable relative to one another by moving either one of the helical gears in the axial direction to vary the intervals between the knife blades, the following advantages are offered.

(1) Since spacers are not used for the adjustment of cut lengths of the sheets A and B, each of the cut lengths can be set at any appropriate value in a stepless manner within the movable ranges of the saw blades.

(2) The cut-off length adjustment operation which necessitated at least 10 minutes in the prior art owing to the provision of spacers, can be finished in about 10 seconds, and a preparatory time therefor is comparatively short. This is extremely important with respect to printing newspapers.

(3) In the prior art, an operator entered the folding machine and carried out the adjustment by means of spacers, whereas according to the present invention, adjustment of the cut-off lengths can be effected from the outside of the folding machine by push-button operations. Accordingly, the adjustment is safe, and at the same time it can be preset by commands from a computer or the like.

While a principle of the present invention has been described above in connection the preferred embodiments of the invention, it is intended that all matter contained in the specification and illustrated in the accompanying drawings shall be interpreted to be illustrative and not as limitative of the scope of the invention.

What is claimed is:

1. In a folding machine of a rotary press consisting of a cutting drum have two knife blades disposed at nearly equal intervals along the circumference thereof, a folding drum, and drive means for rotating the folding drum synchronously with but in the opposite direction to said cutting drum, a cut-length adjusting apparatus for adjusting the length at which sheets are to be cut by said cutting drum, said cut-length adjusting apparatus characterized in that said cutting drum comprises an outer cylinder and an inner cylinder each having one knife blade respectively projecting therefrom and rotatable therewith, and said cut-length apparatus further including a respective helical gear provided at an axial end of at least one of said outer cylinder and said inner cylinder, and a respective helical gear provided at at least one axial end said folding drum and respectively meshing with the helical gear provided at the axial end of at least one of said outer cylinder and said inner cylinder, one of a said helical gear at the axial end of either said outer or inner cylinder and a said helical gear at one axial end of said folding drum being movable in the axial direction, said outer and inner cylinders being rotatable relative to one another by moving said one of said helical gears in the axial direction.

2. In a folding machine of a rotary press, the cut length adjusting apparatus as claimed in claim 1, wherein first helical gears are provided, respectively, at axial ends of both said outer and said inner cylinders and mesh with a said helical gear provided at at least one axial end of said folding drum, and one of the helical gear at the axial end of either said outer or inner cylinder and a said helical gear at at least one axial end of the folding drum is movable in the axial direction,.

3. In a folding machine of a rotary press, the cut length adjusting apparatus as claimed in claim 2, wherein said first helical gears are provided at axial ends of said outer and inner cylinders that are opposite one another.

4. In a folding machine of a rotary press, the cut length adjusting apparatus as claimed in claim 2, wherein said first helical gears are provided at axial ends of said outer and inner cylinders that are on the same side as one another.

* * * * *